US005991950A

United States Patent [19]

Schenkel

[11] Patent Number: 5,991,950

[45] Date of Patent: Nov. 30, 1999

[54] PROCESS FOR ATTACHING A SHOE UPPER TO A SOLE BY APPLYING CLASPS, AND THE RESULTING SHOE

[76] Inventor: Decio Luiz Schenkel, Rua General Emilio Lucio Esteves, 1353, Taquara-RS, Brazil

[21] Appl. No.: 09/243,544

[22] Filed: Feb. 3, 1999

[30] Foreign Application Priority Data

Feb. 4, 1998 [BR] Brazil ..... 9800549

[51] Int. Cl.[6] ..... A43D 9/00; A43B 23/20

[52] U.S. Cl. ..... 12/142 T; 36/12; 36/11.5; 36/23

[58] Field of Search ..... 12/142 T; 36/11.5, 36/12, 15, 23, 101

[56] References Cited

U.S. PATENT DOCUMENTS

| | | | |
|---|---|---|---|
| 1,915,333 | 6/1933 | Rosenblum | 36/23 |
| 2,368,314 | 1/1945 | Mark | 36/11.5 |
| 2,509,335 | 5/1950 | Dadisman | 36/11.5 |
| 4,839,948 | 6/1989 | Boros | 36/101 |
| 5,896,684 | 4/1999 | Lin | 36/11.5 |

*Primary Examiner*—M. D. Patterson

[57] ABSTRACT

A process for attaching a shoe upper to a sole includes the steps of forming clasps having inner and outer staples, folding the clasps around the ends or edge of the upper so that the inner staples attach the clasps to the upper, and inserting clasped portions of the upper into corresponding apertures formed in the sole so that the outer staples attach the upper to the sole.

2 Claims, 2 Drawing Sheets

PROCESS FOR ATTACHING A SHOE UPPER TO A SOLE BY APPLYING CLASPS, AND THE RESULTING SHOE

BACKGROUND AND SUMMARY OF THE INVENTION

The present invention relates generally to shoes and, more particularly, to a process for attaching a shoe upper to a sole by applying clasps, and the resulting shoe.

A first aspect of the present invention is generally characterized in a process for attaching a shoe upper to a sole by applying clasps to an edge or ends of the upper, and inserting the clasps into apertures formed in the sole, this arrangement forming an article which is extremely resilient and flexible, imparting comfort to the user. Each clasp includes inner and outer staples, the inner staples attaching the clasp to an end or edge of the upper, and the outer staples attaching the above assembly (i.e., the clasp and the end of the upper) to the sole upon insertion of the above assembly into the sole apertures. The upper and the sole can be manufactured from any material suitable for performing their respective functions, e.g. leather, plastics, fabric, etc. The clasps can also be manufactured from any material which is suitable for performing its respective function such as, for example, metal (iron, steel, bronze, etc.), plastics, or any other material which is suitable to perform the twofold function of attaching itself to the upper and to the sole. The upper can be made up of individual strips having respective ends or edges, or the upper can have a continuous edge, the clasps being attached thereto so that the ends, along with the clasps, can be inserted into corresponding apertures of about the same size formed in the sole. In one embodiment, a shoe is illustrated having an upper made up of a combination of wide and narrow strips; however, in accordance with the present invention, the clasps can be applied to any type of shoe including, but not limited to, a shoe having an upper with a continuous edge.

A second aspect of the present invention is generally characterized in a shoe fabricated in accordance with the above process.

The invention will be better understood by way of the accompanying drawings, represented by figures briefly described as follows, when taken along with the description below.

DESCRIPTION OF THE PREFERRED EMBODIMENTS

Figure 1:
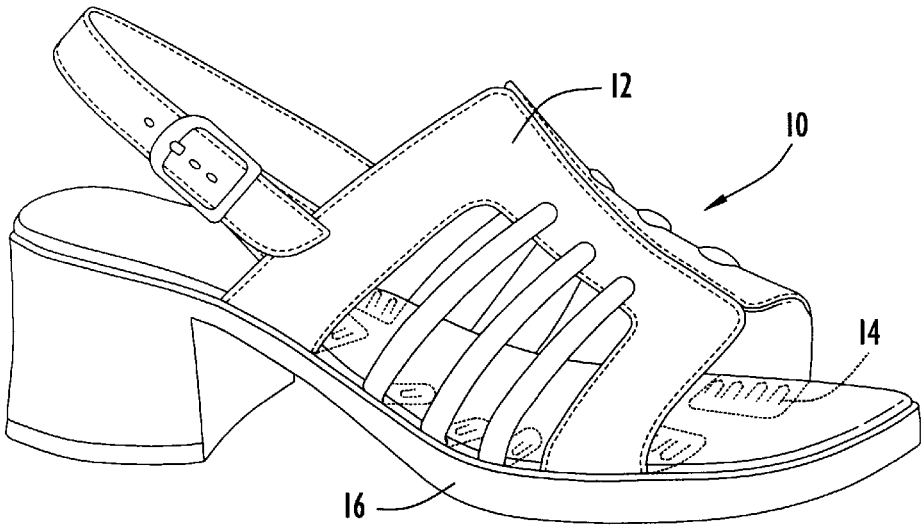
FIG. 1 is a perspective view of an exemplary shoe assembled using a clasp system in accordance with the present invention.
Figure 2:
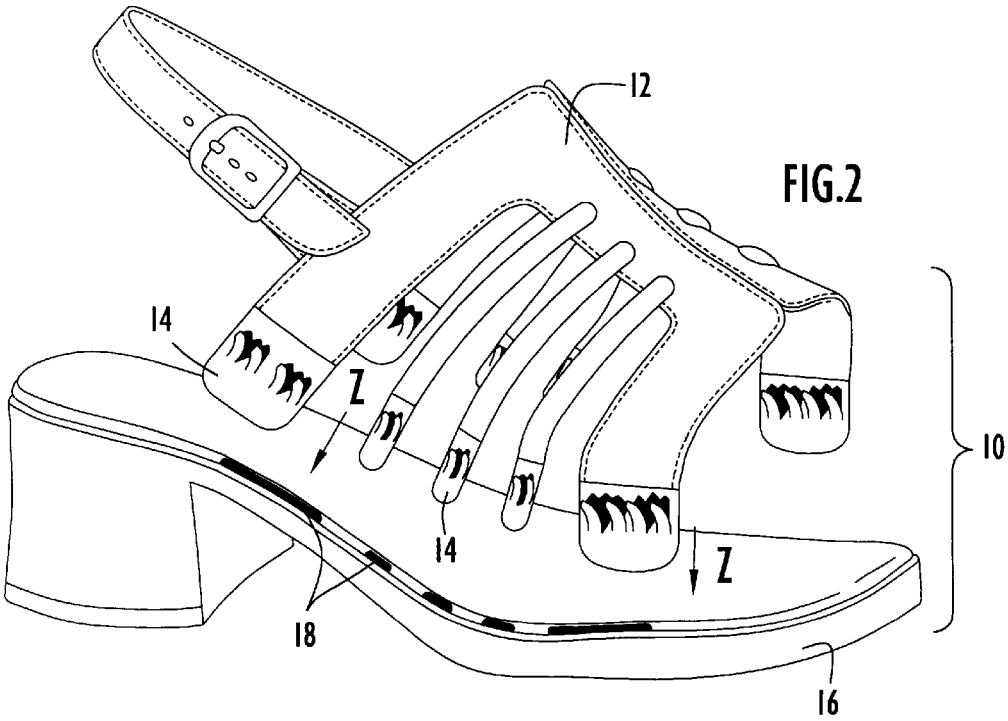
FIG. 2 is an exploded perspective view of the shoe shown in FIG. 1 showing the upper and the sole spaced apart.

Referring to FIG. 1, a shoe 10 having an upper 12 formed by wide and narrow strips is shown as an exemplary embodiment to illustrate how, in accordance with the present invention, clasps 14 can be applied to an upper made up of strips irrespective of the width thereof. FIG. 1 shows the shoe 10 in an assembled or finished state wherein the upper 12 is attached to a sole 16 with clasps 14. Only the upper 12 and the sole 16 are visible in FIG. 1, the clasps 14 having already been inserted into apertures in the shoe sole 16 as indicated by broken lines. FIG. 2 is an exploded view of the shoe of FIG. 1 showing the shoe upper 12 and the sole 16 spaced apart before the clasps 14 are inserted into the apertures 18 in the sole, the clasped ends being moved in the general direction of the arrows Z during the assembly process. The apertures 18 are shown in FIG. 2 as slots formed at spaced locations along the edge of the sole 16. It is seen in FIG. 2 that each of the apertures 18 is aligned with a clasp 14 and that each aperture has a size and shape compatible with, or commensurate with, the size and shape of a corresponding clasp 14, such that the clasp fits snugly within the aperture to securely attach the upper 12 to the sole 16.

Figure 3:
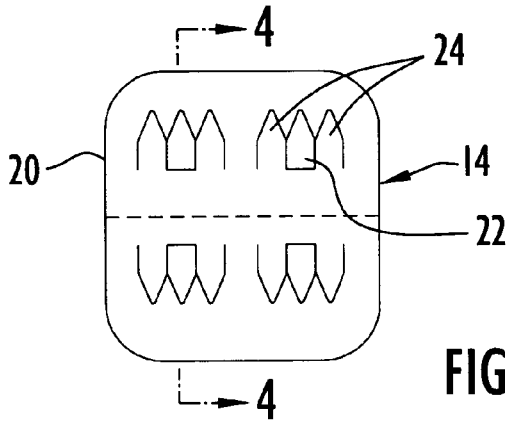
FIG. 3 is a frontal view of a plate forming a clasp in accordance with the present invention.
Figure 4:
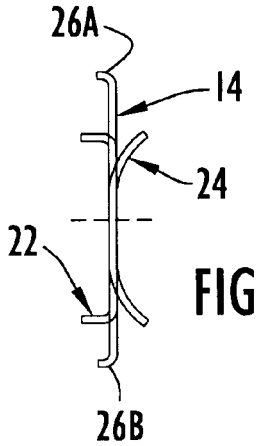
FIG. 4 is a transverse sectional view of the plate shown in FIG. 3, taken through line 4—4, in order to better illustrate the attaching staples.

A clasp 14 for attaching a shoe upper to a sole in accordance with the present invention is shown in FIG. 3 as a plate 20 out of which are formed inner and outer tabs 22 and 24, respectively. The inner and outer tabs 22 and 24 are formed at opposite ends of the plate 20 and can be conveniently folded to form inner and outer staples, respectively, which attach (a) the clasp 14 to the upper 12, and (b) the upper 12 to the shoe sole 16. FIG. 4 is a sectional view of the clasp 14 showing an example of how the inner and outer staples 22 and 24 can be folded in accordance with the present invention. As can be seen, the inner and outer staples 22 and 24 protrude from the plate 20 in opposite directions. Looking at FIG. 4, it can also be seen that opposite ends or edges 26A and 26B of the clasp 14 can be folded inwardly in the same direction as the inner staples 22 to help secure the clasp to the upper.

Figure 5:
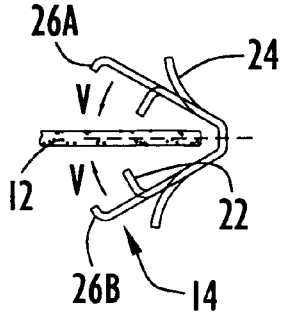
FIG. 5 is a transverse sectional view of the clasp in a partly closed position around the end or edge of a shoe upper.

To attach the upper 12 to the sole 16, the clasps 14 are attached to the strips of the upper and then inserted into the apertures 18 formed in the sole. Attaching a clasp 14 to the upper 12 involves folding the clasp around the bottom edge or end of the upper strip (e.g., along the bend axis shown by broken lines in FIGS. 3–5) such that the inner staples 22 penetrate into the upper from both sides. FIG. 5 shows a clasp 14 with opposite ends 26A and 26B folded toward one another in the general direction of arrows V, the clasp being shown partly folded around the end or edge of an upper strip before the inner staples 22 have penetrated into the strip of the upper 12. With the clasp 14 folded completely around the edge of the upper 12, it will be appreciated that the outer staples 24 protrude from the edge of the upper in generally opposite directions. As the clasps 14 are inserted into the apertures 18 in the sole 16, the outer staples 24 deflect inwardly to facilitate insertion but resist withdrawal by springing outwardly to engage sides of the apertures. The clasps 14 thus become attached to the sole 16 such that the upper 12 is completely and securely attached to the sole 16 thereby forming the desired shoe. Moreover, the clasps provide an attachment which is extremely resilient and flexible, thereby imparting comfort to the user.

While the invention has been described with reference to a shoe having an upper formed of spaced strips, it will be appreciated that the shoe can be formed with a continuous upper instead of strips, the continuous upper being united to the sole by means of the same clasps 14 conceived for the strips. It should also be noted that the upper and the sole can each be manufactured from a single independent matrix, as per a patent application of the same inventor. Minor alterations in the form of the shoe during the manufacturing process, in order to accommodate specific customer orders, provided that the inventive concept is not altered, also remain protected by the accompanying claims.

Inasmuch as the present invention is subject to many variations, modifications and changes in detail, it is intended that all subject matter discussed above or shown in the accompanying drawings be interpreted as illustrative only and not be taken in a limiting sense.

What is claimed is:

1. A process for attaching a shoe upper to a sole by applying clasps comprising the steps of: (a) providing foldable clasps having foldable inner and outer tabs; (b) folding the inner and outer tabs in opposite directions to form inner and outer staples; (c) placing the clasps on the shoe upper by folding the clasps around an edge of the upper such that the inner staples penetrate into the upper; and (d) inserting each clasp into a corresponding aperture in the shoe sole whereby the clasps become attached to the shoe sole by engagement of the outer staples thereby uniting the upper to the sole.

2. A shoe comprising an upper, a sole with apertures formed therein, and a plurality of clasps folded around an edge of said upper and inserted into said apertures, said clasps each having inner staples penetrating said upper and outer staples engaging said apertures in said sole to unite the upper to the sole.

* * * * *